US007478687B2

(12) United States Patent
Lynde et al.

(10) Patent No.: US 7,478,687 B2
(45) Date of Patent: Jan. 20, 2009

(54) COILED TUBING CONVEYED MILLING

(75) Inventors: Gerald D. Lynde, Houston, TX (US); John P. Davis, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 163 days.

(21) Appl. No.: 11/180,880

(22) Filed: Jul. 13, 2005

(65) Prior Publication Data

US 2006/0011344 A1 Jan. 19, 2006

Related U.S. Application Data

(60) Provisional application No. 60/589,053, filed on Jul. 19, 2004.

(51) Int. Cl.
*E21B 31/08* (2006.01)
*E21B 27/00* (2006.01)

(52) U.S. Cl. ..... 175/57; 175/312; 166/99; 166/227

(58) Field of Classification Search ..... 166/227, 166/236, 99; 175/92, 57, 312
See application file for complete search history.

(56) References Cited

U.S. PATENT DOCUMENTS 2,797,755 A * 7/1957 Bobo ..... 175/312
3,198,256 A * 8/1965 Kirby, II ..... 166/99
3,280,923 A * 10/1966 Muench ..... 376/273
3,712,115 A * 1/1973 Miller ..... 73/49.1
4,452,313 A 6/1984 McMahan
4,469,174 A * 9/1984 Freeman ..... 166/202
4,809,793 A 3/1989 Hailey
5,014,780 A 5/1991 Skipper
5,123,489 A 6/1992 Davis et al.
5,176,208 A 1/1993 Lalande et al.
5,265,675 A 11/1993 Hearn et al.
5,287,930 A 2/1994 McGill
5,402,850 A 4/1995 Lalande et al.
5,765,640 A 6/1998 Milne et al.
5,881,816 A 3/1999 Wright
6,102,060 A 8/2000 Howlett et al.
6,152,220 A 11/2000 Carmichael et al.
6,152,221 A 11/2000 Carmichael et al.

(Continued)

FOREIGN PATENT DOCUMENTS

GB 2272923 6/1994

(Continued)

OTHER PUBLICATIONS

Baker Hughes, Baker Oil Tools, Circulation Control Joint Technical Information, Oct. 1, 2003, 1 page.

(Continued)

*Primary Examiner*—Shane Bomar
(74) *Attorney, Agent, or Firm*—Steve Rosenblatt

(57) ABSTRACT

Milling in casing that is over 4½ inches is done with coiled tubing that is anchored against torque reaction. An improved debris catcher is part of the bottom hole assembly to capture cuttings from the milling. A thruster can be used to maintain weight on the mill during the milling. The coiled tubing supports a mud motor to drive the mill. Return fluid is separated from the cuttings and returned to the surface.

24 Claims, 3 Drawing Sheets

U.S. PATENT DOCUMENTS

| | | | | |
|---|---|---|---|---|
| 6,152,228 | A | 11/2000 | Carmichael | |
| 6,176,311 | B1 | 1/2001 | Ryan | |
| 6,220,357 | B1 | 4/2001 | Carmichael et al. | |
| 6,227,291 | B1 | 5/2001 | Carmichael et al. | |
| 6,250,387 | B1 | 6/2001 | Carmichael et al. | |
| 6,253,861 | B1 | 7/2001 | Carmichael et al. | |
| 6,276,452 | B1 | 8/2001 | Davis et al. | |
| 6,279,657 | B1 | 8/2001 | Carmichael et al. | |
| 6,305,469 | B1 * | 10/2001 | Coenen et al. | 166/250.01 |
| 6,431,292 | B2 * | 8/2002 | Mocivnik et al. | 175/314 |
| 6,454,009 | B2 | 9/2002 | Carmichael et al. | |
| 6,478,088 | B1 | 11/2002 | Hansen et al. | |
| 6,719,052 | B1 | 4/2004 | Harmon et al. | |
| 6,776,231 | B2 | 8/2004 | Allen | |
| 6,896,074 | B2 * | 5/2005 | Cook et al. | 175/50 |
| 6,951,251 | B2 * | 10/2005 | Penisson | 166/312 |
| 7,188,675 | B2 | 3/2007 | Reynolds | |
| 7,264,047 | B2 * | 9/2007 | Brezinski et al. | 166/202 |
| 2002/0104649 | A1 | 8/2002 | Allen | |
| 2002/0162655 | A1 * | 11/2002 | Lynde et al. | 166/99 |
| 2005/0217864 | A1 | 10/2005 | Carmichael | |

FOREIGN PATENT DOCUMENTS

| | | | |
|---|---|---|---|
| GB | 2335687 | A * | 9/1999 |

OTHER PUBLICATIONS

Baker Hughes, Baker Oil Tools, Pump Out Sub Technical Information, Jun. 7, 2005, 1 page.

BJ Services Company, Dual Ball-Drop Circulating Sub Product Information, Apr. 11, 2006, 1 page.

MFCT, Mechanical Wellbore Cleanup: Circulating Sub (Weight); Heavy Duty Clutch Type; SPS International 2006, 2 pps.

* cited by examiner

COILED TUBING CONVEYED MILLING

PRIORITY INFORMATION

This application claims the benefit of U.S. Provisional Application No. 60/589,053, filed on Jul. 19, 2004.

FIELD OF THE INVENTION

The field of the invention related to milling downhole with a bottom hole assembly delivered on coiled tubing with provisions to absorb torque reaction from milling and to collect generated debris near the milling location.

BACKGROUND OF THE INVENTION

Workovers in existing wells can require removal of packers or plugs by milling them out. Other occasions can also occur where there is a need to mill out a tool or even a casing section. If the well is not too deviated, rigid tubing has been used to support a mill and the rotation force provided from surface equipment. Alternatively, where the deviated nature of the wellbore precludes rotation from the surface, the bottom hole assembly includes a mud motor to turn the mill. The bottom hole assembly is still delivered on rigid tubing but such tubing above the mud motor remains stationary, with the output of the mud motor driving the mill below. In either alternative a workover rig must be erected over the well to handle the rigid tubing string for trips into and out of the well. There is a fair amount of expense associated with erecting the rig on site and handling the tubing to assembly and disassemble the string for trips into the well. It would be advantageous if a coiled tubing unit could be used at the surface instead of a workover rig. Being able to use coiled tubing would save time and money for the operator over using rigid tubing. However, the use of coiled tubing creates other issues that are not of concern when using rigid tubing. The main problem is that coiled tubing is considerably weaker than rigid tubing. During milling a reaction torque is created that is passed to the supporting tubing. In the past, milling on coiled tubing has been attempted in small casings that are less than 4-½ inches with equally small mud motors driving the mill. These attempts worked, after a fashion, because the torque output from the motor and the resultant torque reaction from milling was sufficiently small so as to not twist the coiled tubing. If the torque reaction turns the coiled tubing it can raise the mill off the packer being milled or bounce it, resulting in erratic milling. Worse still, the coiled tubing can fail from being over-torqued. For this reason milling with coiled tubing was limited in the past to very small applications, generally with casing sizes fewer than four inches.

The milling process generates debris in the wellbore. Even if a milling job in a larger casing were attempted with small coiled tubing and an equally low powered mud motor, the return flow in the larger casing sizes would reduce the velocity of the returning fluid so as to allow the debris to drop out rather than be carried to the surface for separation with surface equipment. While debris catchers of various designs are known they have operational shortcomings. Some require a separate trip. They generally let the debris-laden fluid passes through an open port on the trip downhole. When the tool is brought uphole, the bypass port is closed and the fluid passes through a screen leaving the debris inside the screen. Some examples of such tools are the H-3015 and the 10084-1 offered by Baker Oil Tools. Some debris catchers can be run in the same trip as the milling equipment but due to the way such tools operate they can't have a mud motor below them.

These tools use a venturi effect to direct the cuttings into the tool and generally must be coupled with specially designed mills that create the type of cuttings that will enter this type of debris catcher. One such tool offered by Baker Oil Tool s is the VACS tool. U.S. Pat. No. 6,176,311 illustrated the concepts of central circulation, annulus diversion of debris into the tool, an interior capture area and screen. This design has been improved in the present invention to minimize issues of plugging and damage to the annulus diverter device when running in or removing the tool. Other debris removal tools are described in U.S. Pat. Nos. 5,176,208; 5,402,850; and 6,276,452.

Anchors for tubing downhole are known, as illustrated in U.S. Pat. No. 6,276,452.

The present invention permits small coiled tubing to support large mud motors for big milling jobs. The coiled tubing is anchored in position and the mud motor operates the mill in conjunction with a thruster to keep the mill on the tool being milled. Other variations are envisioned that secure the coiled tubing against torque reaction while allowing the mill to progress and mill out downhole. An improved debris catcher is incorporated into the assembly with greater debris retention capacity and other operational enhancements to improve its operation. These and other aspects of the invention will be more readily apparent to those skilled in the art from the description of the preferred embodiment and the claims that appear below.

SUMMARY OF THE INVENTION

Milling in casing that is over 4-½ inches is done with coiled tubing that is anchored against torque reaction. An improved debris catcher is part of the bottom hole assembly to capture cuttings from the milling. A thruster can be used to maintain weight on the mill during the milling. The coiled tubing supports a mud motor to drive the mill. Return fluid is separated from the cuttings and returned to the surface.

DETAILED DESCRIPTION OF THE PREFERRED EMBODIMENT

Figure 1A:
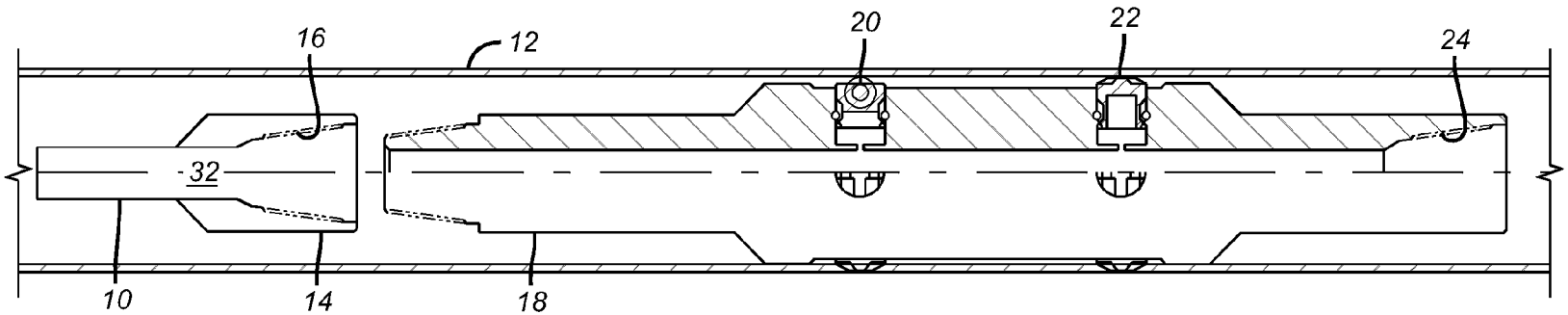
FIGS. 1*a-e* are a sectional elevation of the bottom hole assembly for coiled tubing milling.
Figure 1B:
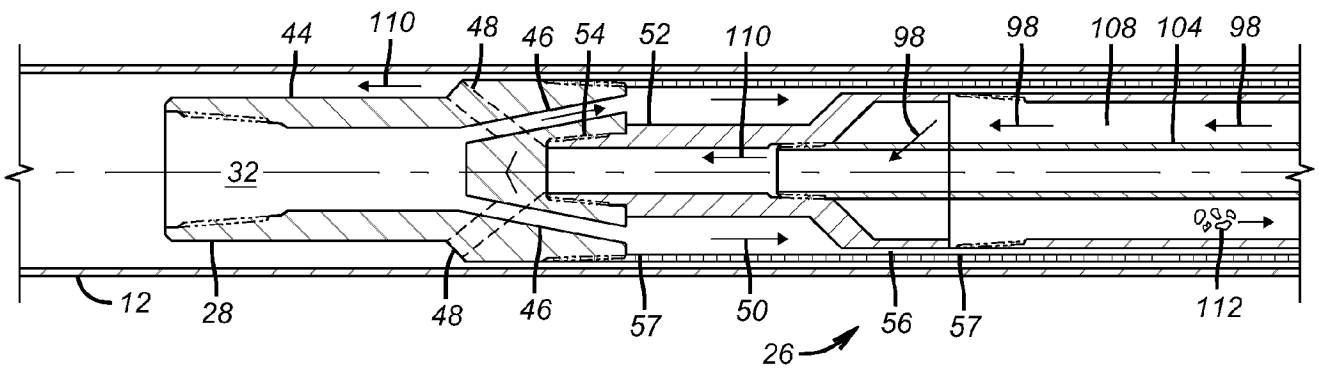
Figure 1C:
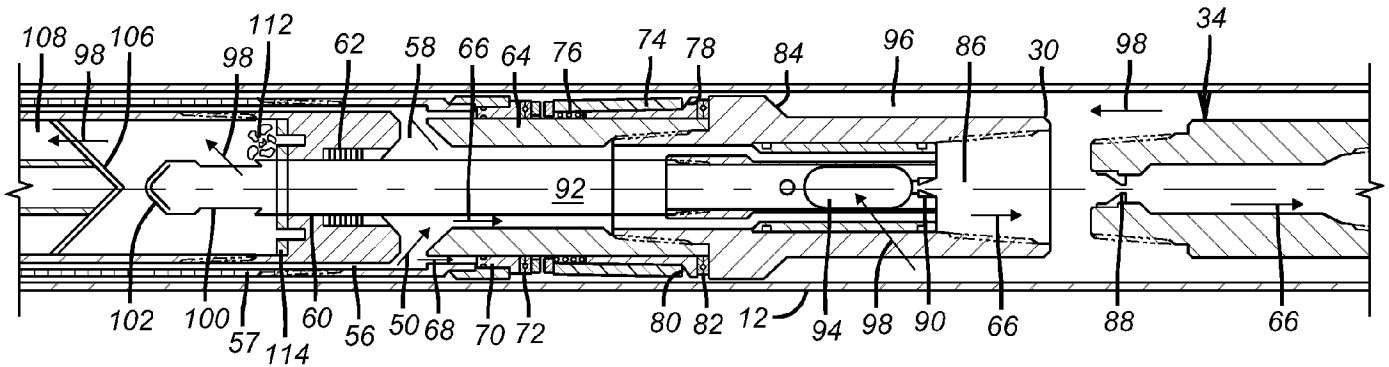
Figure 1D:
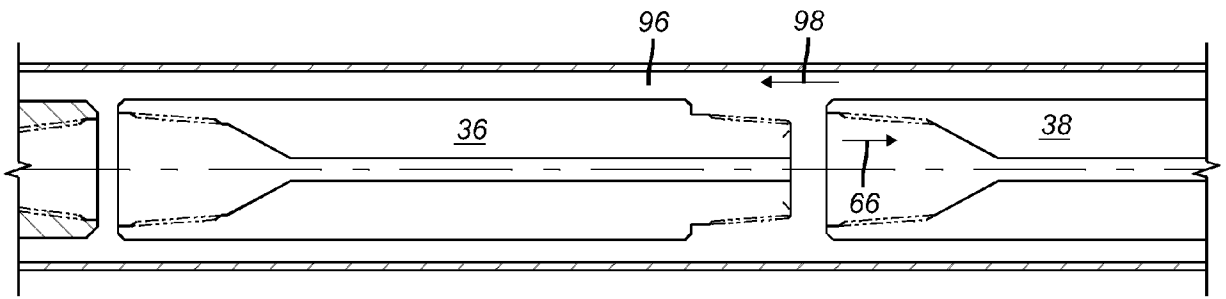
Figure 1E:
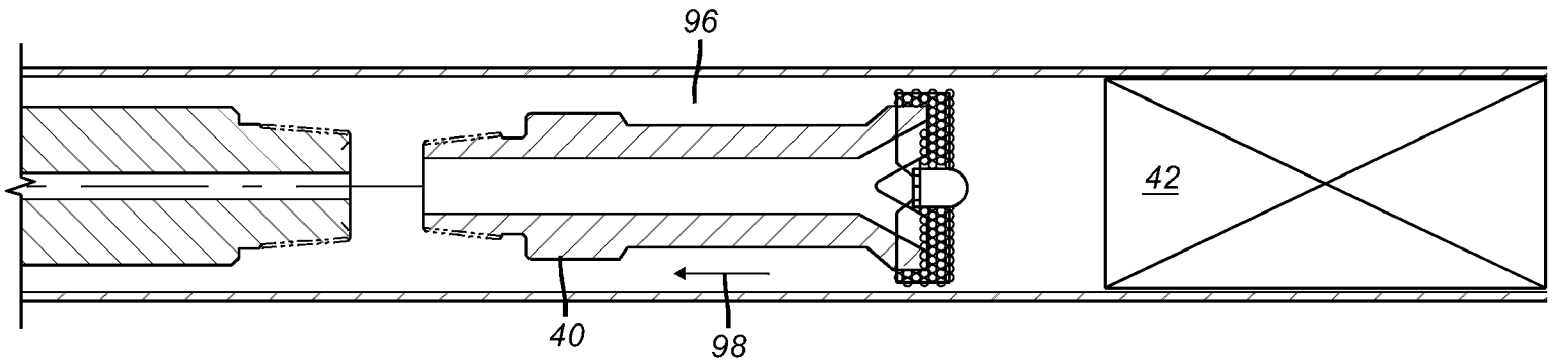

Referring to FIG. 1*a*, coiled tubing 10 is run into casing 12. At the lower end 14 is a threaded connection 16 to which an anchor 18 is attached. The anchor 18 is preferably of a known design as described in U.S. Pat. No. 6,276,452. It features extending gripping members 20 and 22 that are hydraulically actuated by fluid circulation down the coiled tubing 10. A connection 24 is at the lower end of the anchor 18 to attach the debris catcher 26. The debris catcher 26 runs from upper end 28 to lower end 30 in FIG. 1*c*. Continuing with the preferred assembly, a jet sub 34 is connected to lower end 30. A mud motor 36 (shown schematically) is connected to jet sub 34. A thruster 38 (shown schematically) is connected to mud motor 36. A mill 40 is connected to the thruster 38. Mill 40 comes in contact with the object 42 (shown schematically) to be milled in the wellbore. That object 42 could be a packer, a bridge plug, another downhole tool, or a section of casing or tubular. Depending on the specific attributes of the components selected they can be attached in different orders. The thruster 38 can be optionally omitted and instead the anchor 18 can be repositioned periodically during the milling by cutting circulation to release the anchor 18 and letting the assembly move down to a new position. At that time the circulation can begin again and the anchor 18 will take another grip of the casing 12. Of course, the anchor 18 is above the mud motor 36 to isolate the coiled tubing 10 from reaction torque from the mill 40 milling the object 42. The coiled tubing 10 can be sized as small as practicable to not only support the load of the bottom hole assembly but also to keep the pressure drop in flow passage 32 at a reasonable level. Initiating flow through the coiled tubing 10 will set the anchor 18 first before any significant milling by mill 40 can take place. At that point the coiled tubing is protected from reaction torque transmitted through the mud motor 36. The mud motor 36 can be of a type known in the art as well as the thruster 38 whose purpose is to keep weight on the mill 40 to hold it against the object 42 for efficient milling. As long as the anchor 18 is properly sized for the casing 12, the other components simply need to be small enough to easily pass through the casing 12. As a result, the illustrated assembly can be rapidly deployed at the surface without a workover rig and the trip time to reach the object 42 to be milled can be greatly reduced as compared to running the bottom hole assembly on rigid tubing. Objects 42 in casing sizes larger than 4-½" can be easily milled out with coiled tubing smaller than 3-½ inches in diameter. It is conceivable that coil tubing as small as 1-¼" could be used to support milling equipment in casing as large as 9-⅝" or larger.

The details of the debris catcher will now be described. Flow enters near the top 28 through passage 32. A diverter sub 44 has downhole-oriented passages 46 spaced apart from uphole return passages 48. Arrow 50 shows the flow beyond passages 46 and around the outside of sleeve 52 that is secured at thread 54 to the diverter sub 44. Flow continues through annular space 56 between the sleeve 52 and the outer screen housing 57 and emerges in FIG. 1*c* as arrow 50. The flow 50 emerges in an annular space 58 around a diverter tube 60. Seals 62 seal around diverter tube 60. Accordingly the pressure is directed downwardly through the inside of sleeve 64 as shown by arrow 66 and outside sleeve 64 as shown by arrow 68. Flow 68 encounters a piston 70 that has a movable bearing 72 below it and a pack off sleeve 74 below the bearing 72. A return spring 76 biases the pack off sleeve 74 uphole to a retracted position. Pressure on piston 70 represented by arrow 68 pushes the piston 70 and bearing 72 downhole against the pack off sleeve 74. A stationary ramp 78 catches the lower end 80 of the pack off sleeve 74 to force it out into sealing contact with the casing 12. In this manner, the pack off sleeve 74 is protected from damage during run in or removal because the return spring 76 keeps it retracted and away from casing 12 until circulation through passage 32 in coiled tubing 10 is established. Another bearing 82 is supported by reverse flow sub 84. Together bearings 72 and 82 allow the pack off sleeve 74 to rotate relative to the sleeve 64 to promote sealing and to minimize wear on the pack off sleeve 74.

The flow 66 through sleeve 64 emerges near lower end 30 of the debris catcher 26 in a chamber 86 between restrictor 88 and venturi jet 90. The venturi jet 90 discharges into return path 92 in diverter tube 60 to reduce pressure in return port 94 so as to draw debris laden fluid in (as will be explained below). Restrictor 88 creates enough backpressure to supply adequate pressure to the venturi jet 90. This restrictor is optional and can be used when the mill nozzles (not shown) are fairly large so that insufficient backpressure is available for proper operation of the venturi jet 90. After going through the restrictor 88 the flow 66 goes to the nozzles in the mill 40 and comes back uphole laden with cuttings in annulus 96 as shown by flow arrow 98.

Flow 98 with cuttings is forced into return port 94 and aided by the action of the venturi jet 90. It passes up the diverter tube 60 and comes out of outlets 100 The top 102 of the diverter tube 60 is capped off above outlets 100. A screen 104 has a lower end 106 capped but the annular space 108 outside the screen is left open for the debris-laden flow 98. The debris free flow 110 goes to the surface outside of the coiled tubing 10. The debris 112 falls down to catch plate 114 which can be many feet below the lower end 106 of screen 104.

Those skilled in the art can appreciate some of the improvements in the debris catcher 26 as compared to the design shown in U.S. Pat. No. 6,176,311. The pack off sleeve 74 is retractable for run in and removal to protect it from damage. A venturi jet 90 accelerates the debris-laden flow 98. The debris-laden flow 98 passes a screen 104 with a relatively large open area reducing the risk of plugging using the random slots of the prior design. The debris storage area below the screen 104 can be quite long to minimize the chance of plugging.

Those skilled in the art will now appreciate that coiled tubing milling is possible with small coiled tubing sizes in casing bigger than 4-½ inches. The coiled tubing is isolated from reaction torque by an anchor. The milling is done with a mud motor with the additional optional use of a thruster to keep weight on the mill. A debris catcher incorporates improvements to enhance performance, capacity and reliability. A hydraulically operated cutter my be used rather than a mill to sever casing.

While the preferred embodiment has been set forth above, those skilled in art will appreciate that the scope of the invention is significantly broader and as outlined in the claims which appear below.

We claim:

1. A method for cutting objects downhole, comprising:

running in a cutting apparatus connected to a downhole motor and an anchor on coiled tubing into a well;

providing a debris catcher in fluid communication with said coiled tubing and an annular space around said coiled tubing during said running in;

setting the anchor;

operating said motor to turn the cutting apparatus;

cutting an object that obstructs the wellbore or cutting a wellbore tubular in two;

catching debris generated by the cutting apparatus and moving in said annular space with said debris catcher.

2. The method of claim 1 , comprising:

locating said debris catcher uphole of said downhole motor.

3. The method of claim 1, comprising:

providing pressurized fluid through said debris catcher to said downhole motor.

4. The method of claim 1, comprising:

providing a retractable flow diverter on an exterior of said debris catcher.

5. The method of claim 4, comprising:

mounting said flow diverter to allow relative rotation with respect to said debris catcher.

6. The method of claim 5, comprising:

providing a ramp to direct said flow diverter to span an annular space around said debris catcher; and biasing said flow diverter away from said ramp.

7. The method of claim 1, comprising:

using pressurized fluid delivered to said debris catcher to create a reduced pressure zone within said debris catcher for drawing debris-laden fluid into said debris catcher.

8. The method of claim 7, comprising:
moving said debris laden fluid past a screen;
passing fluid through said screen;
providing a catch volume below said screen for debris that did not pass through said screen.

9. The method of claim 1, comprising:
moving fluid to operate said cutting apparatus through said debris catcher in an opposite direction than debris laden fluid entering said debris catcher.

10. The method of claim 1, comprising:
setting said anchor by supplying pressure in said coiled tubing; and
providing a thruster adjacent said cutting apparatus that is actuated by said pressure in said coiled tubing.

11. A method for cutting objects downhole, comprising:
running in a cutting apparatus connected to a downhole motor and an anchor on coiled tubing into a well;
providing a debris catcher on said coiled tubing during said running in;
setting the anchor;
operating said motor to turn the cutting apparatus;
catching debris generated by the cutting apparatus with said debris catcher;
providing a retractable flow diverter on an exterior of said debris catcher;
using pressurized fluid delivered to said debris catcher to actuate said flow diverter to close an annular space around said debris catcher.

12. A debris catcher for downhole use, comprising:
a body having a first passage to conduct pressurized fluid therethrough and a second passage to accept debris;
a flow diverter selectively radially extendable from said body after delivery downhole to impede flow in an annular space around said body to direct debris into said second passage, said diverter during delivery retracted to said body and out of said annular space, said passages remaining open whether said diverter is retracted or extended.

13. The debris catcher of claim 12, further comprising:
a tool string adapted to extend into a wellbore and a hydraulically operated tool connected to said string, said body mounted to said string.

14. The debris catcher of claim 13, wherein:
said body is mounted further up the wellbore than said tool.

15. The debris catcher of claim 13, wherein:
said body is mounted further down the wellbore than said tool.

16. A debris catcher for downhole use, comprising:
a body having a first passage to conduct pressurized fluid therethrough and a second passage to accept debris;
a flow diverter selectively radially extendable from said body after delivery downhole to impede flow in an annular space around said body to direct debris into said second passage, said diverter during delivery retracted to said body and out of said annular space;
a nozzle that uses fluid from said first passage to induce debris to enter said second passage.

17. The debris catcher of claim 16, further comprising:
an inlet opening to said second passage, said nozzle directing fluid across said opening to move debris away from said inlet opening.

18. The debris catcher of claim 16, further comprising:
a screen, having a bottom and mounted within said second passage creating an annular flowpath around it while debris is retained in said second passage in a space located below the bottom of said screen as fluid passes through said screen.

19. The debris catcher of claim 16, further comprising:
said second passage is nested within said first passage;
said first passage comprises a restriction to create pressure buildup that is directed to said nozzle.

20. A debris catcher for downhole use, comprising:
a body having a first passage to conduct pumped fluid therethrough and a discrete second passage to accept debris;
a venturi nozzle that uses pumped fluid from said first passage to reduce pressure and thereby induce fluid laden with debris to enter said second passage at a distance from a screen and thereafter push said fluid laden with debris from behind, said fluid laden with debris moving through said second passage in said body toward said screen and in a direction opposite from pumped fluid movement in said first passage, whereupon said debris remains in said second passage and said fluid exits said second passage.

21. The debris catcher of claim 20, further comprising:
an inlet opening to said second passage, said venturi nozzle directing fluid across said opening to move debris away from said inlet opening.

22. The debris catcher of claim 20, further comprising:
said screen having a bottom and mounted within said second passage creating an annular flowpath around it while debris is retained in said second passage in a space located below the bottom of said screen as fluid passes through said screen.

23. The debris catcher of claim 22, further comprising:
a flow diverter mounted to said body to impede flow in an annular space around said body to direct debris into said second passage.

24. The debris catcher of claim 20, further comprising:
said second passage is nested within said first passage;
said first passage comprises a restriction to create pressure buildup that is directed to said venturi nozzle.

* * * * *